US005462461A

United States Patent [19]

Jgorevich

[11] Patent Number: 5,462,461

[45] Date of Patent: Oct. 31, 1995

[54] WATER JET PROPULSIVE DEVICE

[76] Inventor: Shevchenko A. Igorevich, Box 366, 103008 Moskve, U.S.S.R.

[21] Appl. No.: 333,259

[22] Filed: Nov. 2, 1994

[51] Int. Cl.[6] ..... B63H 11/00

[52] U.S. Cl. ..... 440/38

[58] Field of Search ..... 440/38, 90, 91, 440/92, 93; 60/221, 222

[56] References Cited

U.S. PATENT DOCUMENTS 150,956 5/1874 Hunter ..... 440/93

3,134,443 5/1964 Snow ..... 440/93

4,735,045 4/1988 Gongwer ..... 440/38

*Primary Examiner*—Stephen Avila

*Attorney, Agent, or Firm*—Ilya Zborovsky

[57] ABSTRACT

A water jet propelling device has a rotor adapted to be located below a waterline and having a front water impermeable wall, a peripheral wall formed by a plurality of blades arranged with gaps therebetween to form a water inlet and extending tangentially to a circumference of the rotor, and a rear water permeable wall which forms a water outlet.

12 Claims, 3 Drawing Sheets

FIG. 6
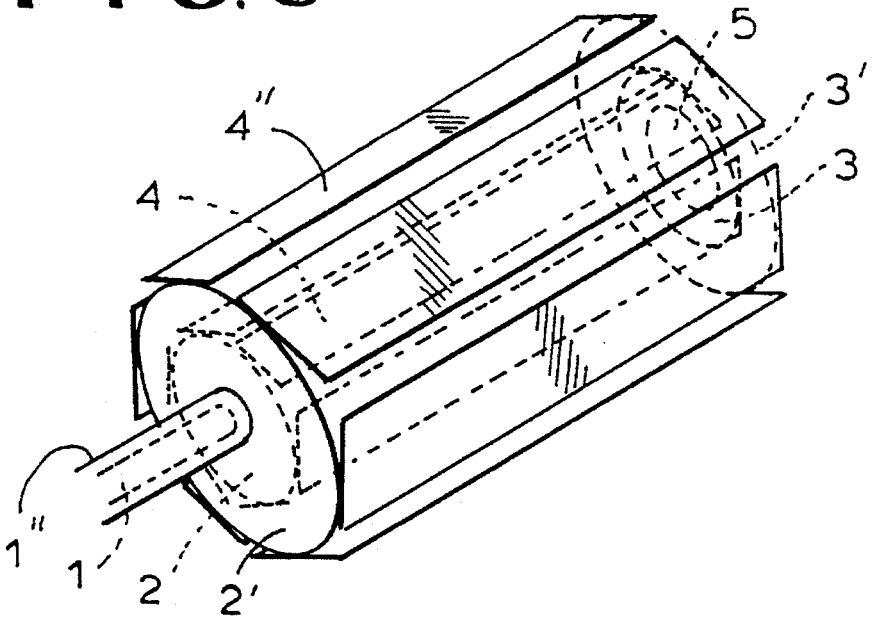
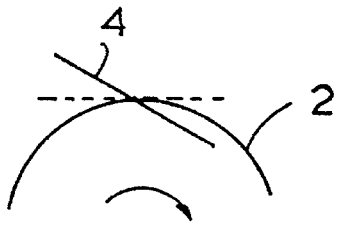
FIG. 7
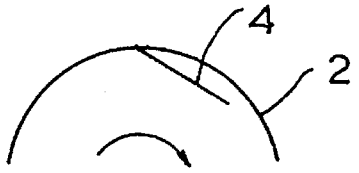
FIG. 8
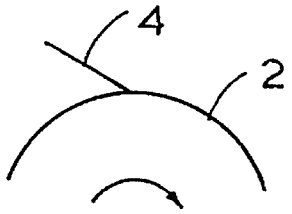
FIG. 9

WATER JET PROPULSIVE DEVICE

BACKGROUND OF THE INVENTION

The present invention relates to water jet propulsive devices of drives which can be used for example in floating means, pumps and the like.

Water jet propulsive devices are well known and designed as centrifugal or axial propulsive devices with a rotor, a water passage, a pump part and a nozzle. A water inlet is located always below a waterline, and thereby a water passage has a turning bend for introducing the pump shaft, or several bends. The known water jet propulsive devices have several disadvantages. For efficient operation a high speed of blades is required, which leads to cavitation. The devices are complicated due to introduction of the shaft into the water passage pipe, complicated shape of the water passage pipe for its connection with the pump and the shaft, and a system of connecting of successive stages in the axial drive and parallel stages in the centrifugal drive. The devices have considerable size due to several stages arranged successively in the axial devices and parallel in the centrifugal devices. Finally, the devices have high hydraulic losses since it is necessary to raise water above a waterline and urge it through bent passages. One of such devices is disclosed in the U.S. Pat. No. 4,735,045, which also has the above disadvantages. It is to be understood that it is desirable to propose water jet propulsive devices which avoid such disadvantages.

SUMMARY OF THE INVENTION

Accordingly, it is an object of the present invention to provide a water jet propulsive device which avoids the disadvantages of the prior art.

In keeping with these objects and with others which will become apparent hereinafter, one feature of the present invention resides briefly stated, in a water jet propulsive device which has a rotor adapted to be located below a waterline and having a front wall which is impermeable for water, a side surface which is permeable to water and forms a water inlet, and a rear side provided with a water outlet, wherein the side surface is formed by a plurality of blades extending tangentially to a circumference of the rotor in an axial direction of the latter.

When the water jet propulsive device is designed in accordance with the present invention it reduces cavitation, is less complicated, has a small size and lower losses.

The novel features of the present invention are set forth in particular in the appended claims: the invention itself, however, both as to its construction and its manner of operation will be best understood from the following description of preferred embodiments which is accompanied by the following drawings.

BRIEF DESCRIPTION OF THE DRAWINGS

FIG. 6 is a view showing still a further modification of the inventive water jet propulsive device; and FIGS. 7–9 show further modifications of vanes of the inventive device.

DESCRIPTION OF PREFERRED EMBODIMENTS

Figure 1:
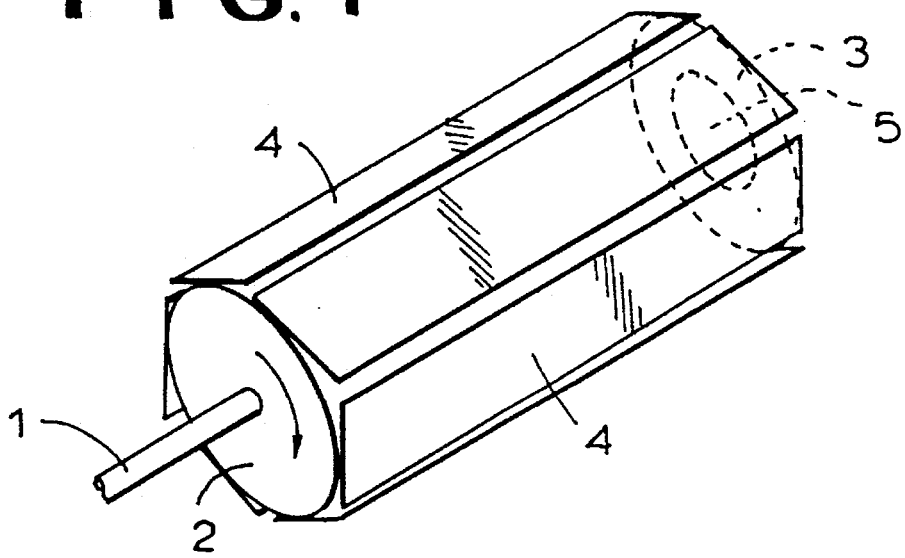
FIG. 1 is a schematic perspective view shown a water jet propulsive device in accordance with the present invention.

A water jet propulsive device in accordance with the present invention as shown in FIG. 1 has a rotor which is to be rotatable about its axis. A shaft of the device is identified with reference numeral 1. The rotor has a front wall which is identified as 2 and carries the shaft 1. The front wall 2 is water impermeable. The rotor further has a peripheral surface which is formed by a plurality of blades 4. The blades 4 are arranged with a gap between two neighboring blades so as to form a water inlet on the peripheral surface of the rotor. A rear wall of the rotor is water permeable and identified as 3. It has a water outlet or nozzle 5. The blades extend tangentially relative to a circumference of the rotor in its axial direction.

The water jet propelling device operates in the following manner. When the shaft 1 is rotated, the front wall 2 is rotated as well so as to rotate the rotor as a whole. The blades 4 row the water and urge it into the interior of the rotor through the peripheral water inlets so as to pump it under pressure. A surplus pressure is formed in the interior of the rotor, and it can be relieved only through the water outlet 5 of the rear wall 3 and therefore the water exits through the water outlet 5.

The value of this pressure is determined by the speed of rotation of the blades and their angle of attack. In the proposed device, as described, the blades extend tangentially to the rotor circumference. This way of providing a surplus pressure is more efficient that in the above cited centrifugal device, in which the greater part of energy is spent for friction against the walls of the rotor. The speed of water flowing out from the water outlet can be increased not only by increasing of the rotor speed of rotation, but also by selection of a ratio of the areas of the water inlet and water outlet. This can be done either by increasing of the rotor diameter or by increasing of its length. This leads to the increase of power required for rotation of the rotor. In other words, there is a kind of exchange of the rotational speed for the consumed power. It should be noted that the limitations of the device with regard to the power are less strict then the limitations with regard to the speed. The latter is directly connected with the value of cavitation.

Figure 2:
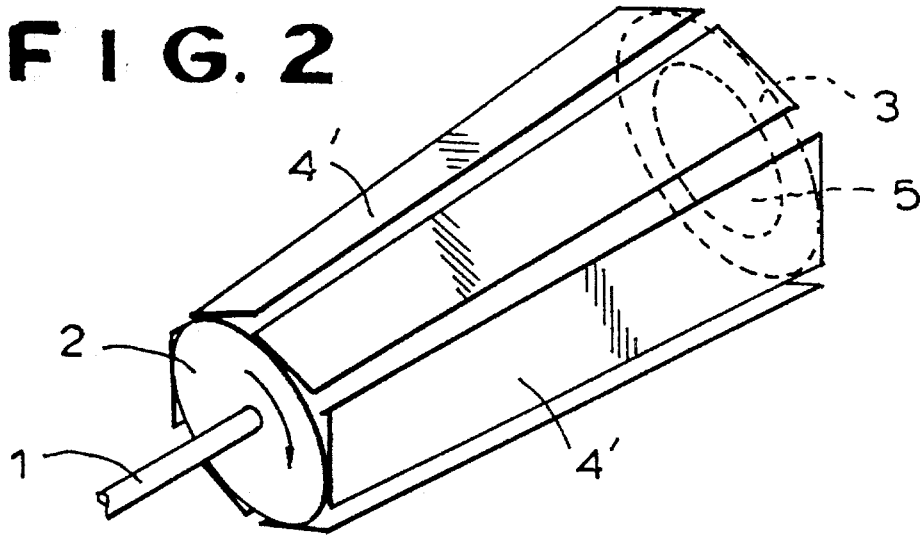
FIG. 2 is a view substantially corresponding to the view of FIG. 1, but showing another modification of the inventive water jet propulsive device.

While the rotor shown in FIG.1 is cylindrical, the rotor shown in FIG. 2 is conical. The blades 4' here are inclined relative to the axis of the rotor and each blade has end sides with different widths.

Figure 3:
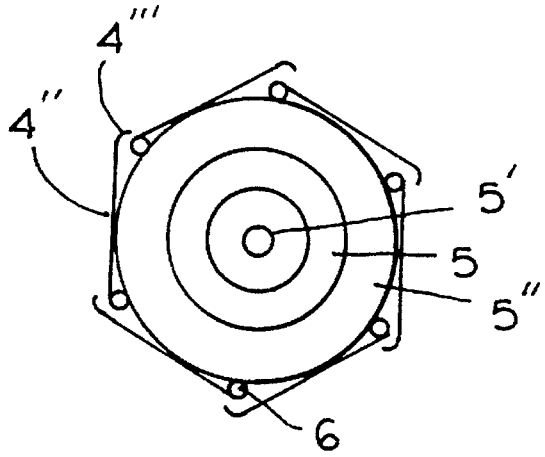
FIG. 3 is an end view of the inventive propulsive device in accordance with a further modification.

In the water jet propelling device shown in FIG.3 the blades 4" have inwardly bent end portions 4'''. This improves rowing of water by the blades into the interior of the rotor. Also the blades are turnable about their points of connection with the plates 2 and 3. For this purpose the blades 4''' can be mounted by hinges 6.

Figure 5:
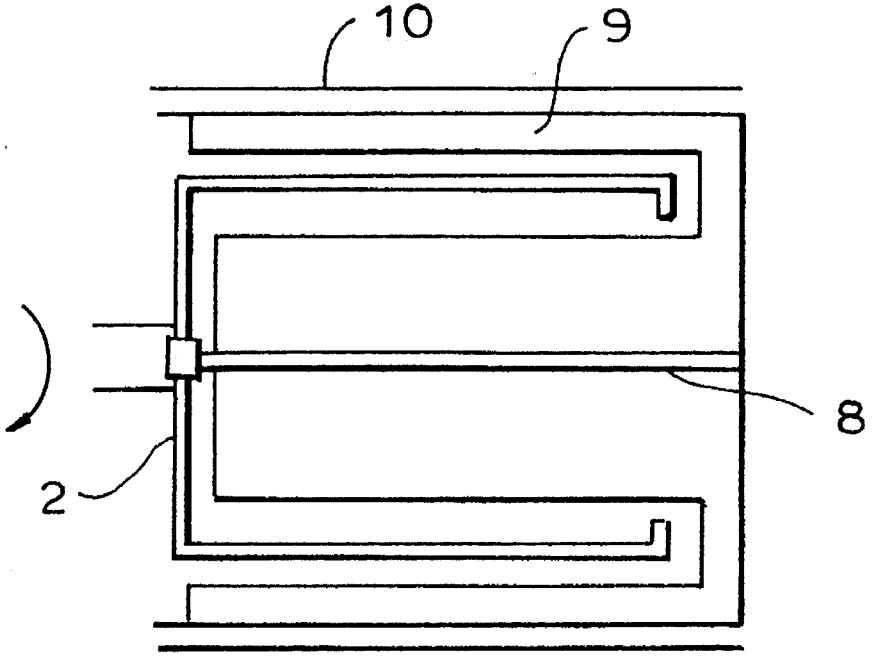
FIGS. 4 and 5 are an end view and a side view of a different modification of the inventive water jet propulsive device.
Figure 4:
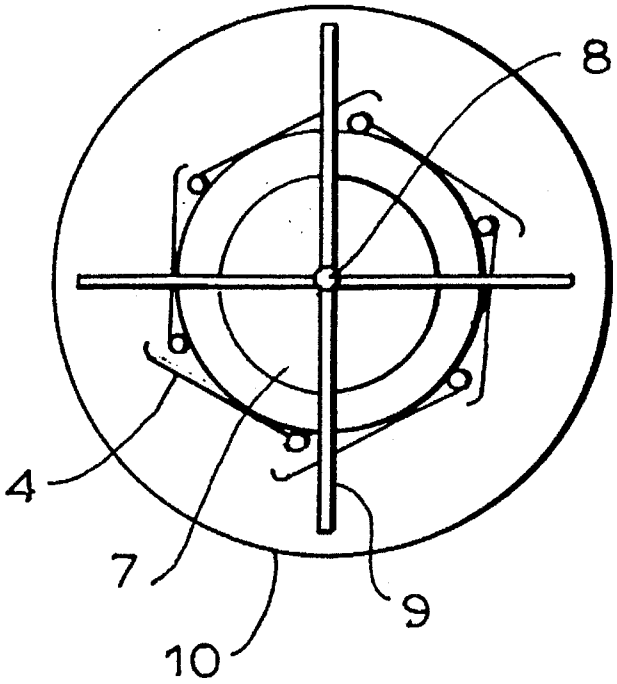

The device can be provided with straightening means or in other words with means for preventing whirling of water inside rotor. This means is shown in FIGS. 4 and 5. The straightening means can include a plurality of vanes 9 which have passages for the blades 4 and are mounted on a central axle 8. The central axle 8 is mounted in a bearing in the front wall 2 of the rotor with its one end, while the other end of the axle extends rearwardly beyond the water outlet and is fixedly connected with an immovable part of the device for example with a housing 10.

The straightening means can be also formed as shown in FIG. 6. Here the straightening means includes an additional rotor with its elements $1^v$, $2^v$, $3^v$, $4^v$, which is located in the interior of the main rotor. The rotors are rotatable in opposite directions, and the blades of both rotors are directed in direction of their rotations.

The water jet propelling device is to be located below a waterline.

As show in FIGS. 7–9, the vanes instead of being a tangent to the circumference of the front and rear walls, can be inclined and connected to the walls correspondingly in the center, by the rear end or by the front end of the vanes.

The device can also be used as a rotor of a motor or a generator.

I claim:

1. A water jet propulsive device, comprising a rotor to be rotated and has an axis, said rotor forming an inner water passage and having a front wall, a peripheral wall, and a rear wall, said rotor being adapted to be located below a waterline, said front wall of said rotor being water impermeable, said peripheral wall of said rotor being formed by a plurality of blades which extend in an axial direction from said front wall rearwardly to said rear wall and are circumferentially spaced from one another to form herebetween gaps which form a water inlet, said rear wall being water permeable so as to form a water outlet, so that during rotation of said rotor water enters an interior of said rotor through said gaps substantially radially and leaves the interior of said rotor substantially axially through said water permeable rear wall so as to propel said rotor axially forwardly.

2. A water jet propulsive device as defined in claim 1, wherein said blades extend tangentially to a circumference of said rotor and in an axial direction of said rotor.

3. A water jet propulsive device as defined in claim 1, wherein said blades are formed and arranged so that said rotor has a cylindrical shape.

4. A water jet propulsive device as defined in claim 1; and further comprising an immovable housing, said straightening means include a plurality of vanes located inside said rotor and immovably connected with said housing.

5. A water jet propulsive device as defined in claim 1, wherein said straightening means is arranged inside said rotor rotatably relative to the latter in an opposite direction.

6. A water jet propulsive device as defined in claim 5, wherein said straightening means is formed as an additional rotor.

7. A water jet propulsion device as defined in claim 1, wherein said blades are inclined relative to a tangent to a circumference of said rotor.

8. A water jet propulsion device as defined in claim 7, wherein said blades are center lines along which they are connected to said front and rear walls.

9. A water jet propulsion device as defined in claim 8, wherein each of said blades has a rear end as considered in direction of rotation of said rotor and is connected by said rear end with said front and rear walls.

10. A water jet propulsion device as defined in claim 7, wherein each of said blades has a front end as considered in direction of rotation of said rotor and is connected by said front end with said front and rear walls.

11. A water jet propulsive device, comprising a rotor to be rotated and has an axis, said rotor forming an inner water passage and having a front wall, a peripheral wall, and a rear wall, said rotor being adapted to be located below a waterline, said front wall of said rotor being water impermeable, said peripheral wall of said rotor being formed by a plurality of blades which extend in an axial direction from said front wall rearwardly to said rear wall and are circumferentially spaced from one another to form herebetween gaps which form a water inlet, said rear wall being water permeable so as to form a water outlet, so that during rotation of said rotor water enters an interior of said rotor through said gaps substantially radially and leaves the interior of said rotor substantially axially through said water permeable rear wall so as to propel said rotor axially forwardly, said blades being formed and arranged so that said rotor has a conical shape with a smaller cross-section in the region of said front wall and a greater cross-section in the region of said rear wall.

12. A water jet propulsive device, comprising a rotor to be rotated and has an axis, said rotor forming an inner water passage and having a front wall, a peripheral wall, and a rear wall, said rotor being adapted to be located below a waterline, said front wall of said rotor being water impermeable, said peripheral wall of said rotor being formed by a plurality of blades which extend in an axial direction from said front wall rearwardly to said rear wall and are circumferentially spaced from one another to form herebetween gaps which form a water inlet, said rear wall being water permeable so as to form a water outlet, so that during rotation of said rotor water enters an interior of said rotor through said gaps substantially radially and leaves the interior of said rotor substantially axially through said water permeable rear wall so as to propel said rotor axially forwardly; and means for straightening a water flow in the interior of said rotor, said straightening means being located immovably inside said rotor.

* * * * *